US005394627A

United States Patent [19]

Eugler

[11] Patent Number: 5,394,627

[45] Date of Patent: Mar. 7, 1995

[54] SKI BOOT

[75] Inventor: Norbert Eugler, Karlsfeld, Germany

[73] Assignee: Silvretta-Sherpas Sportartikel GmbH, Karlsfeld, Germany

[21] Appl. No.: 991,962

[22] Filed: Dec. 17, 1992

[30] Foreign Application Priority Data

Dec. 20, 1991 [DE] Germany ..... 41 42 391.7

[51] Int. Cl.[6] ..... A43B 5/04

[52] U.S. Cl. ..... 36/117; 280/614; 280/615

[58] Field of Search ..... 36/117, 119, 50.5; 280/614, 615

[56] References Cited

U.S. PATENT DOCUMENTS

| | | | |
|---|---|---|---|
| 3,612,558 | 10/1971 | Sollentuna et al. | 280/615 |
| 3,824,713 | 7/1974 | Vaccari | 36/117 |
| 4,000,567 | 1/1977 | Salomon | 36/117 |
| 4,129,319 | 12/1978 | Strohmeier | 280/615 |
| 4,154,008 | 5/1979 | Jacobs | 280/615 X |
| 4,176,856 | 12/1979 | Glaser | 280/615 X |
| 4,235,452 | 11/1980 | Linecker | 280/615 |
| 4,309,044 | 1/1982 | Schmidt | 280/615 |
| 4,319,767 | 3/1982 | Emilson | 280/614 |

FOREIGN PATENT DOCUMENTS

| | | | |
|---|---|---|---|
| 1168038 | 12/1958 | France | 280/614 |
| 2657257 | 6/1978 | Germany | 280/614 |
| 3222752 | 12/1983 | Germany . | |
| 0224221 | 7/1985 | Germany | 280/614 |
| 0019021 | 9/1908 | Norway . | |
| 0078117 | 1/1918 | Switzerland | 280/615 |

*Primary Examiner*—Paul T. Sewell
*Assistant Examiner*—Ted Kavanaugh

[57] ABSTRACT

The ski boot which is particularly suitable for ski jumping has a flexible sole which projects over the front boot cap for cooperating with a clamping device of a front sole holder. The projecting area of the boot sole has a half-rounded flute extending transversely to the longitudinal axis of the boot at its upper side. A cut out portion which is open toward the rear and sides is provided in the area of the boot heel and is penetrated by a peg which is received by the lower defining wall and the upper defining wall of the cut out portion and is arranged at a certain distance from the vertically arranged defining wall of the cut out portion. This peg serves to fasten a tension member which is detachably fastened to the peg by a clamp.

1 Claim, 5 Drawing Sheets

SKI BOOT

BACKGROUND OF THE INVENTION a. Field of the Invention

The invention is directed to a ski boot with a flexible sole which projects beyond the front boot toe-piece or cap to cooperate with a clamping device of a front sole holder.

b. Background Art

In known ski boots of this type, the underside of their projecting part is provided with holes which cooperate with pegs arranged at the sole holder. A clamping device presses on the projecting part so as to hold the boot on the pegs of the sole holder. Such ski boots are known as long-distance boots. This construction requires a front sole holding device having no front guide jaw for the boot, since this would impede the insertion of the boot on the pegs. Due to the absence of a guide jaw receiving the boot in a positive-locking manner, it cannot absorb particularly great lateral forces and especially not upwardly directed jump-off forces occurring when jumping off a ski-jump.

OBJECT AND SUMMARY OF THE INVENTION

The primary object of the present invention is to provide a ski boot, particularly for ski jumping, which enables a positive-locking holding of the boot in a front jaw in combination with a simply constructed clamping device.

This object is met according to the invention by a ski boot of the type described above in that the projecting front area of the boot sole has at its upper side a half-rounded groove or flute which extends transversely to the longitudinal axis of the boot along the entire width of the sole. As a result of this construction, the boot can be used with a front sole holding device in which a clamping shaft which is rotatable by means of a lever is rotatably supported on both sides at the vertical legs of a front jaw. The clamping shaft is flattened between the legs by means of a recessed portion extending at least to the center of the shaft. The curved, rounded part of the recessed portion engages in the flute in the projecting boot sole in the clamping position. This can be used as an easily operated, lightweight clamping device in which the segment-like construction of the clamping shaft which engages in the flute of the boot sole when rotated draws the latter into the guide jaw when the clamping shaft is rotated, so that the boot sole is wedged into the guide jaw, which improves the lateral support of the boot in the guide jaw. The construction according to the invention also has the advantage that the cooperation of the boot with the boot sole cannot be impaired by snow or other impurities as is the case with holes in the underside of the boot sole.

The construction of the front side of the ski boot according to the invention not only enables its use in ski jumping, but boots of this type can also be constructed as long-distance or touring ski boots.

A special construction of the ski boot which is particularly suitable for ski jumping is characterized in that a cut out portion which is open at the rear and to the sides is constructed in the heel area of the boot and has a defining wall disposed vertically relative to the boot sole and two defining walls extending parallel to the boot sole, which defining walls receive a peg which is arranged vertically relative to the boot sole at a distance from the vertical defining wall and penetrates the cut out portion. A tension member can be fastened to this peg by means of an attachable clamp adapted to the height of the cut out portion, the other end of the tension member being fastened at a spring which is arranged so as to be fixed with respect to the ski in order to exert a resilient resistance when lifting the heel of the boot. This tension member is constructed so as to be flexible in every direction so as not to hinder the boot heel from swiveling out laterally during the releasing process of a front safety binding. Such a construction of the boot heel for attaching a tension member is taken into consideration when the front safety binding can release in the manner of a rotating plate, making it unnecessary to fix the boot heel laterally. A fixed stop, as required in ski jumping, is also adjustable by means of this tension member to ensure a better control of the ski during the ski jump. The tension member can also be constructed as an elastic ribbon and can be arranged so as to be fixed at the ski.

The cut out portion can be constructed in the boot sole.

However, an embodiment form in which the cut out portion is constructed above the boot sole projecting to the rear in a hump which is constructed in the heel area and adapted to the shape of the boot is preferable. A weakening of the boot sole is accordingly prevented. Moreover, the cut out portion which is constructed higher up protects better against the penetration of snow or dirt.

A particularly simple construction of the boot in the rear area is characterized in that the boot sole projects to the rear beyond the bootleg and a cylindrical peg with two flanges constructed at a distance from one another is arranged on the projecting sole in its center. This construction is not particularly pretty with respect to design, but is inexpensive to produce. It fulfills its purpose as well as the previously described embodiment forms since a clamp can be attached to the peg between the flanges and a tension member is fastened to the clamp so as to limit the lift or exert an elastic resistance with a limiting of the lift.

According to another construction of the ski boot, particularly for ski jumping, a bushing aligned in the direction of the longitudinal axis of the boot can be inserted in the rear part of the boot heel in the center of same, which bushing is open toward the rear so as to receive a plug-in peg of a heel holding device. Accordingly, it is possible to use the ski boot in combination with a safety binding for jump skiing in which it is necessary to fix the boot laterally at its heel to ensure a release of the front sole holding device when overloaded, while nevertheless enabling a lifting of the boot heel from the ski. A peg of a sliding piece can be inserted in the bushing arranged at the boot heel, which sliding piece is guided so as to be displaceable substantially vertically relative to the surface of the ski at a guide arm of a rear sole holding device. This type of connection of the ski boot with the rear sole holding device makes it possible to detach the boot from the sole holding device without difficulty when a releasing process has taken place at the front sole holder.

When the bushing is widened conically internally and externally in a further development of the invention and the inner wall of the bushing is provided with longitudinal grooves which are arranged close together, this not only facilitates the insertion of the peg of the sliding piece, but also prevents the peg from jamming in the bushing during the lateral releasing process, which could hinder the separation of the boot from the rear sole holding device. Moreover, it is ensured that possible accumulations of snow will be displaced by the peg in the longitudinal grooves so that hindrances caused by snow are ruled out in practice.

The invention is explained in more detail in the following with the aid of embodiment examples shown in the drawing.

DESCRIPTION OF THE PREFERRED EMBODIMENTS

As shown in FIGS. 1 to 4, a ski boot 1 has a sole 2 with an area 3 which projects over the front boot cap, a half-rounded flute 4 being constructed at its upper side. This flute extends transversely relative to the longitudinal axis of the boot and stretches over the entire projecting sole area 3.

Figure 1:
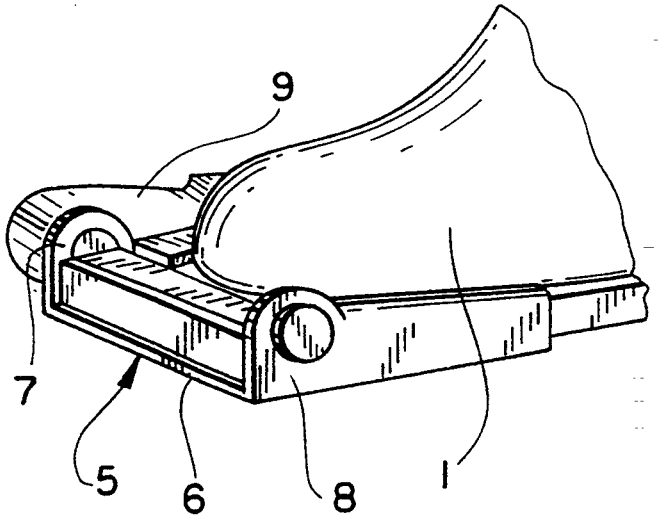
FIG. 1 shows a view of a ski boot clamped in a guide jaw with clamping device.
Figure 2:
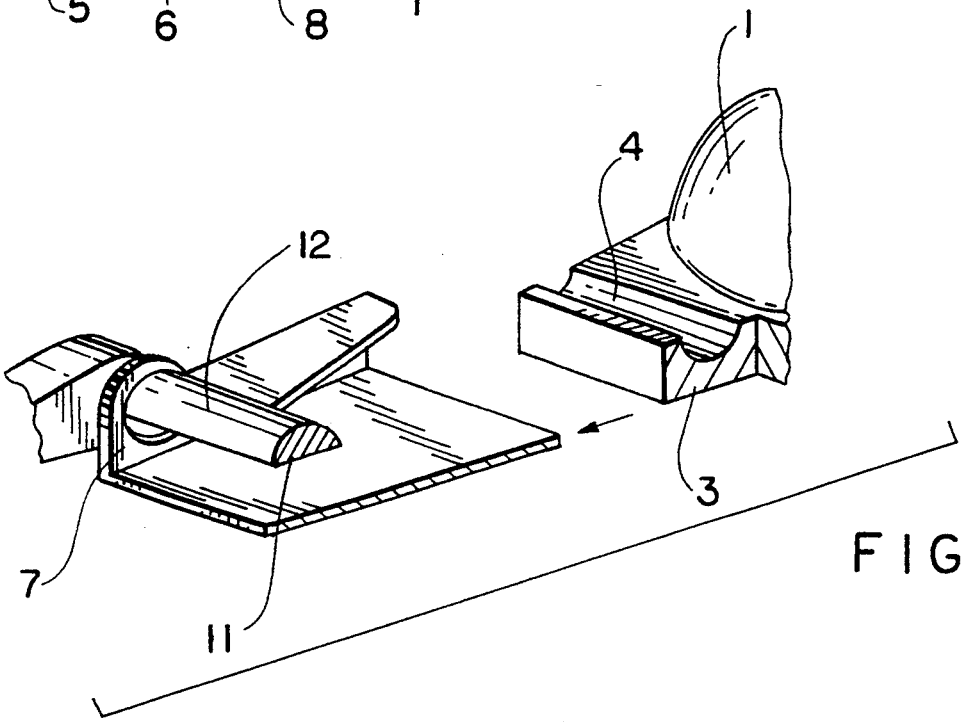
FIG. 2 shows a longitudinal section through the ski boot and the guide jaw with clamping device at the start of the insertion process.
Figure 3:
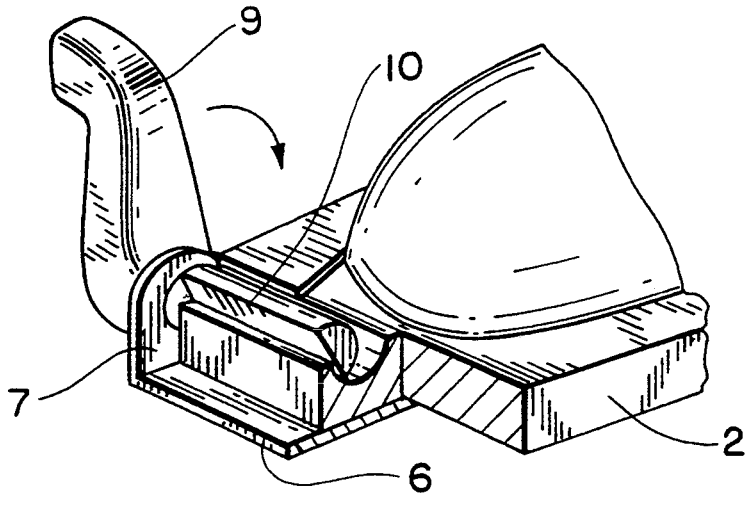
FIG. 3 shows a longitudinal section through the ski boot and the guide jaw with clamping device during the clamping process.
Figure 4:
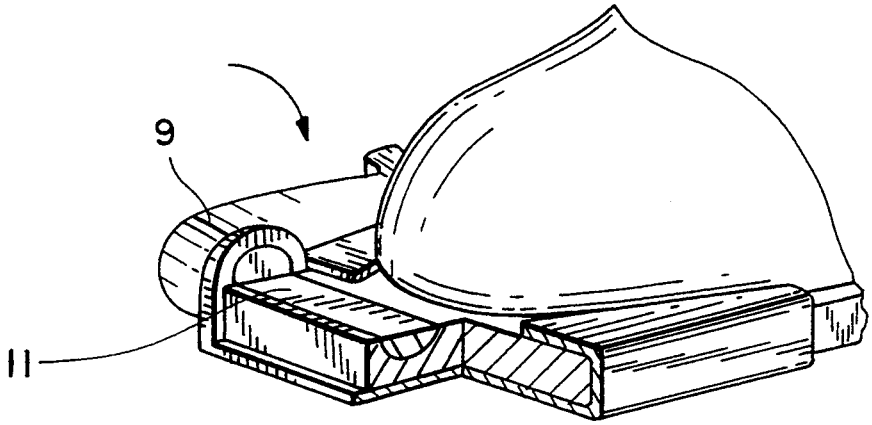
FIG. 4 shows a longitudinal section through the ski boot and the guide jaw with clamping device in the clamped state of the ski boot.

The front sole holding device in which a ski boot which is constructed in this way can be inserted has a guide jaw 5 which includes a base part 6 as well as two lateral legs 7 and 8 which are arranged vertically relative to the surface of the ski. A clamping shaft 10 is supported in the legs 7 and 8 so as to be rotatable by means of a lever 9. The clamping shaft has a recessed portion which extends at least to the center of the shaft, leaving a segment-like flattened portion 11. The lever 9 is swiveled forward to clamp the ski boot so that the flattened portion 11 faces downward as shown in FIG. 2. The tip of the boot can accordingly be slid under the clamping shaft. The lever 9 is then swiveled and the clamping shaft 10 is accordingly rotated and engages in the groove 4 as shown in FIG. 3. The final state is shown in FIG. 4 where the lever 9 is swiveled back completely and the rounded portion 12 of the clamping shaft 10 engages in the groove 4 in a positive-locking manner. This construction has the advantage that the tip of the boot is drawn forward into the jaw 5 during the swiveling of the lever 9 by the engagement of the clamping shaft 10 in the flute 4. This ensures a positive-locking fit of the boot in the front jaw.

Figure 5:
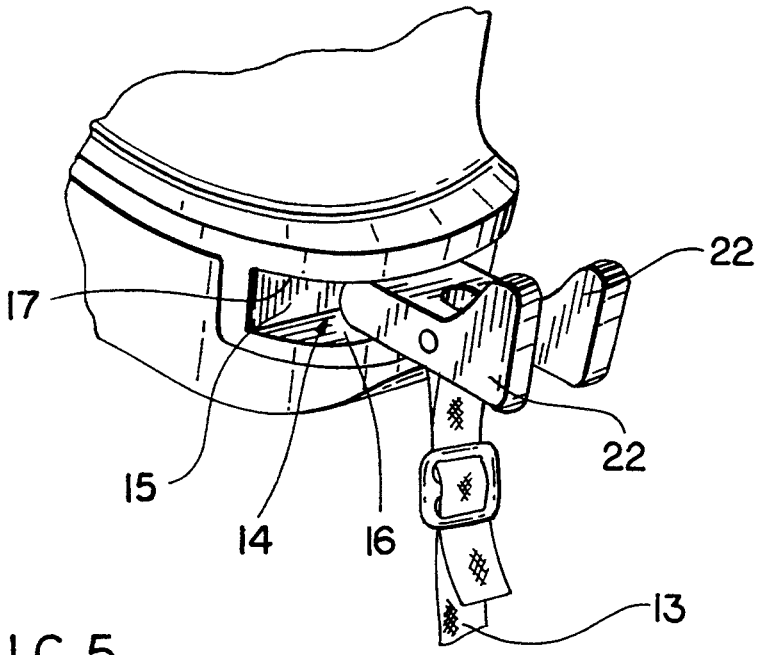
FIG. 5 shows a view of a boot heel with a part of a heel holding device.
Figure 6:
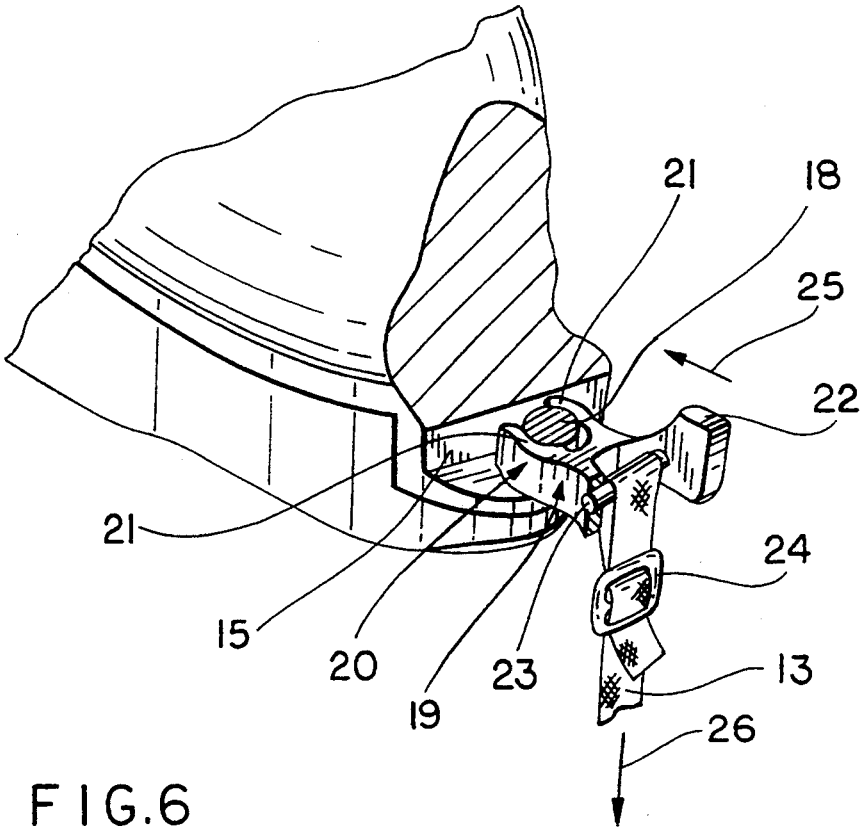
FIG. 6 shows the view according to FIG. 5, partially broken off.
Figure 7:
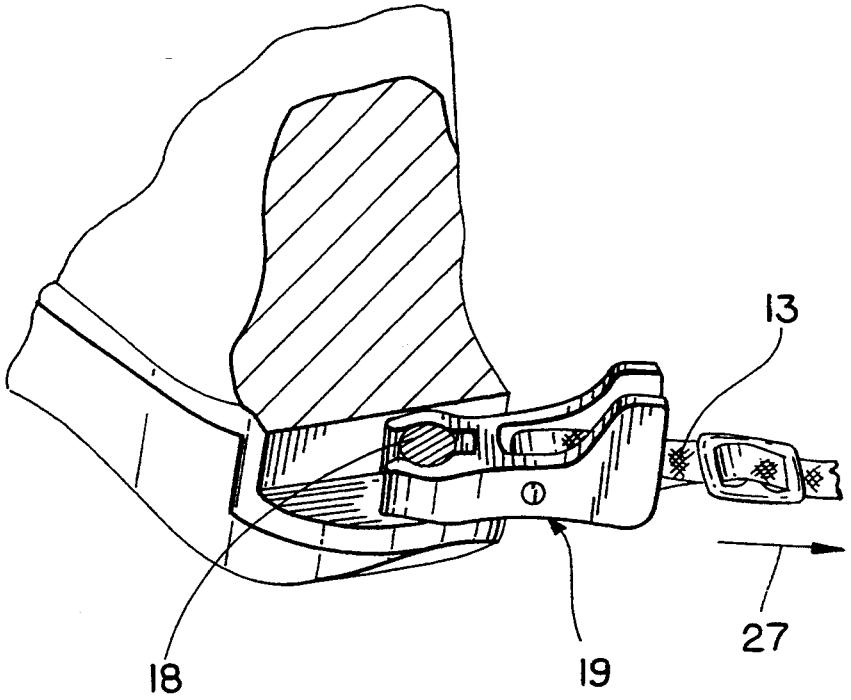
FIG. 7 shows a view corresponding to FIG. 6 with a swiveled part of the heel holding device during the releasing process.

FIGS. 5 to 7 show a construction of a boot heel used particularly in jumping boots for detachably fastening a tension member 13 so that when the heel of the boot is lifted a resilient resistance and a limiting of this lifting of the boot heel can be adjusted. For this purpose, the boot heel has a cut out portion 14 which is open at the rear and to the sides and is defined by a defining wall 15 arranged vertically relative to the boot sole and by two defining walls 16 and 17 extending parallel to the boot sole. The defining walls 16 and 17 receive a peg 18 which is arranged vertically relative to the boot sole at a certain distance from the vertical defining wall 15 and penetrates the cut out portion 14. The tension member 13 can be detachably fastened to this peg 18 by a clamp 19. For this purpose, the clamp 19, which is constructed in the manner of pincers, includes a head 20 having two grippers 21. Two legs 22 are constructed so as to form one piece with the head 20. A pin 23 which bridges the intermediate space between the two legs 22 and serves to fix the tension member 13 is inserted through the legs 22. The end of the tension member 13 is looped around this pin and fixed so as to be adjustable by means of a buckle 24. The clamp 19 can be attached to the peg 18 in the direction of the arrow 25 accompanied by brief resilient deformation of the grippers 21. The head 20 has a height corresponding to the height of the cut out portion 14 so that the clamp 19 is laterally swivelable in the front safety binding as the boot heel swivels out laterally when released, as shown in FIG. 7. But the clamp cannot be tilted, so that it can transmit the tensile forces in the direction of the arrow 26 as required for exerting a resilient resistance when the heel is lifted. On the other hand, if a tensile loading occurs in the direction of the arrow 27 which is directed substantially parallel to the boot sole, the clamp 19 can be pulled off the peg 18. This is necessary for disengaging the boot from the tension member 13 when it is released from the front safety binding.

Figure 8:
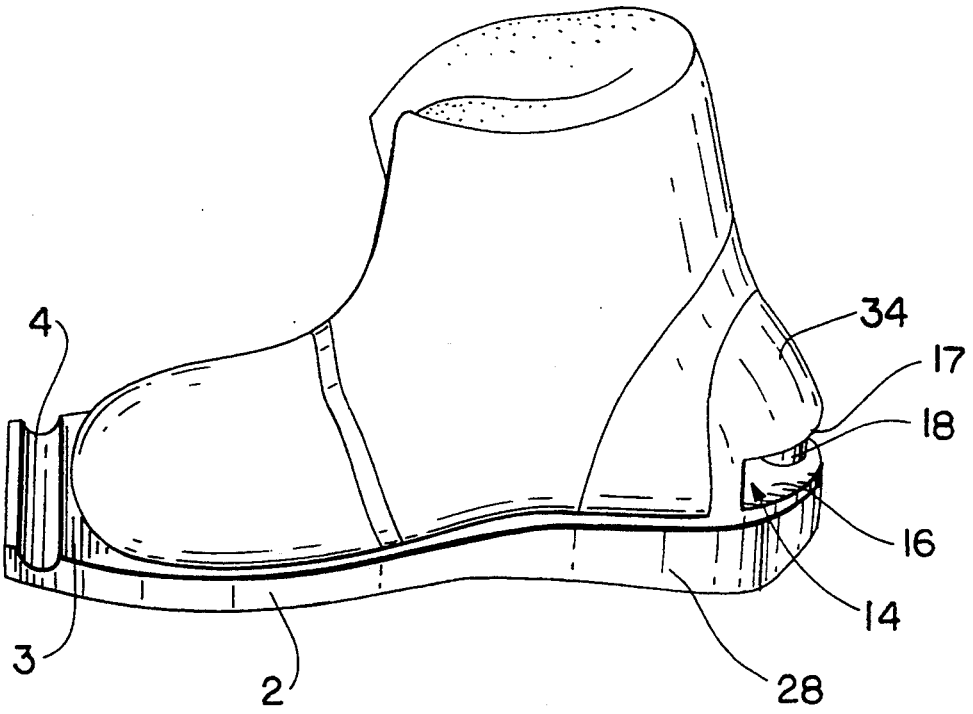
FIG. 8 shows a view of a preferred embodiment form of a ski boot.

FIG. 8 shows a ski boot which is constructed in the front area corresponding to FIGS. 1 to 4 and has a particularly preferred construction in the rear area. This consists in that the cut out portion 14 with the peg 18, which cut out portion 14 is open toward the rear and sides, is constructed in a hump 34 which is constructed on a portion of the boot sole 28 projecting to the rear, the hump 34 being adapted to some extent to the shape of the boot. The open cut out portion 14 is constructed in the same way as is described in connection with FIGS. 5 to 7. The only difference with respect to the previously described construction consists in that this cut out portion 14 with the peg 18 is constructed above the sole of the boot in the additionally formed hump 34 rather than in the sole of the boot.

Figure 9:
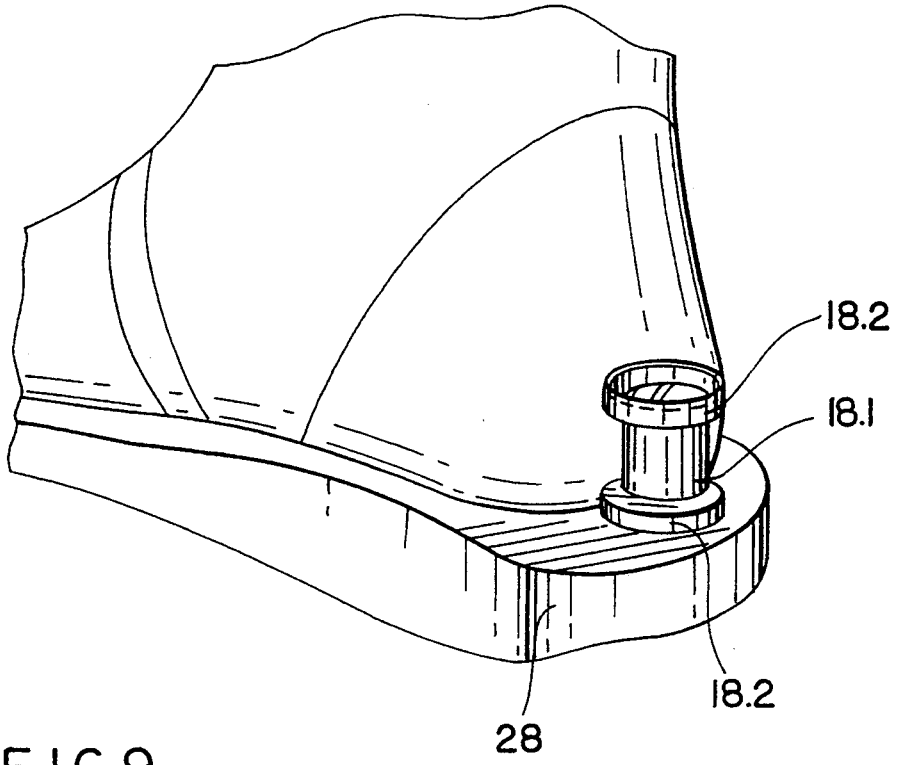
FIG. 9 shows a rear view of a particularly simple construction of a ski boot.

FIG. 9 shows a particularly simple construction in which a cylindrical peg 18.1 with two flanges 18.2 is fastened on the portion of the boot sole 28 projecting toward the rear. The clamp 19 can be fastened at the peg 18.1 between the flanges 18.2 which prevent a tilting of the clamp, as do the defining walls 16 and 17 extending parallel to the boot sole in the previously described embodiment forms according to FIGS. 5 to 7 and 8.

Figure 10:
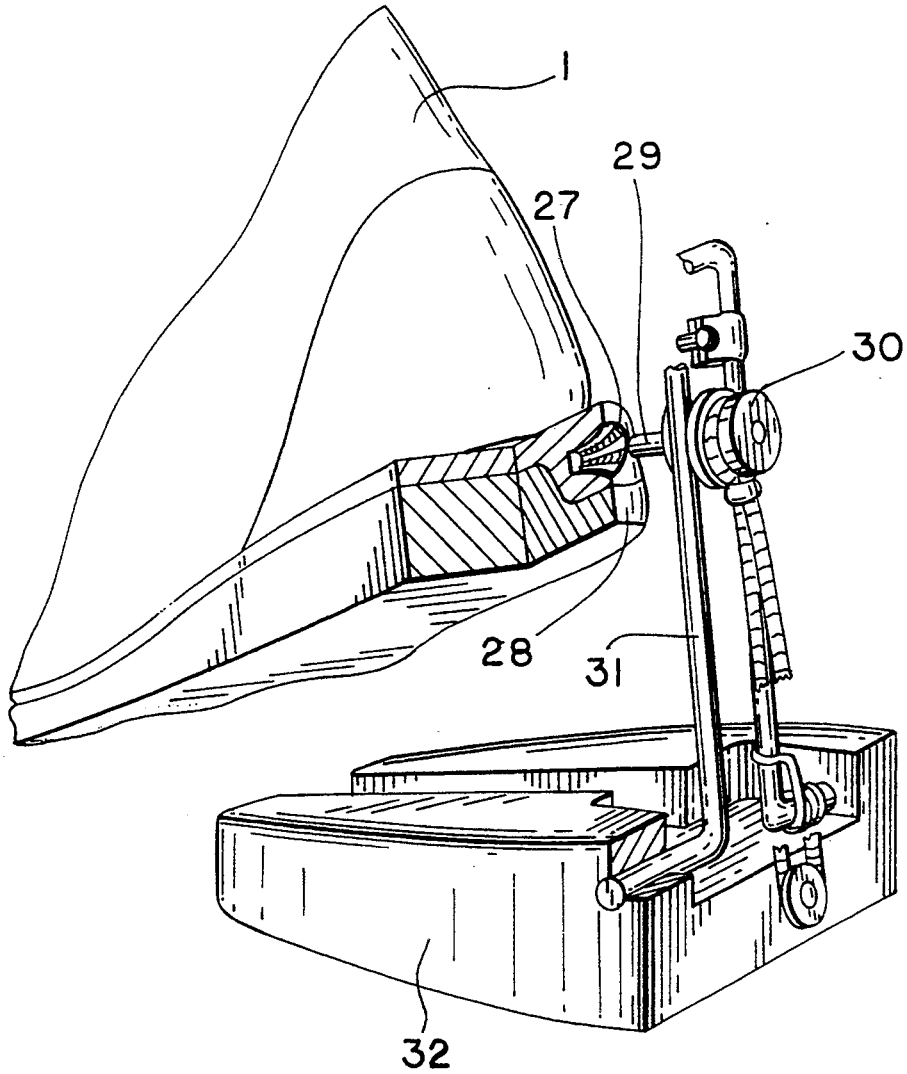
FIG. 10 shows a view of another embodiment form of the ski boot from the rear in combination with a heel holding device.
Figure 11:
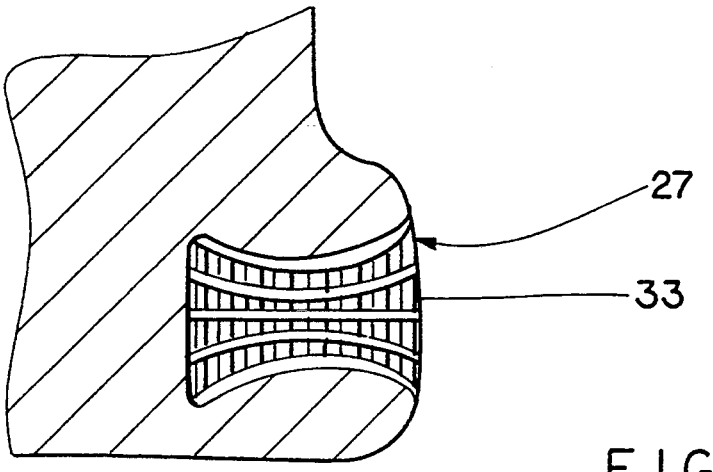
FIG. 11 shows a partial section through the boot heel according to FIG. 10 in the longitudinal direction of the boot sole.

FIGS. 10 and 11 show a construction of a boot heel for use in a safety binding, particularly for jump skiing, which has a heel holding device which fixes the boot heel in the lateral direction to ensure an oppositely directed moment during a lateral release of the tip of the boot. In this construction, a bushing 27 is provided in the boot heel 28 of the ski boot 1 for receiving a peg 29 which is fastened to a sliding piece 30. The sliding piece 30 is guided so as to be displaceable in the vertical direction, i.e. vertically relative to the surface of the ski at the guide arm 31 which is swivelably supported at a base part 32 fastened on the ski. The boot heel is fixed in the lateral direction by the engagement of the peg 29 in the bushing 27, so that the forces occurring when the boot is released from its front jaw can be absorbed at the boot heel.

The bushing 27 is conically widened internally and externally and has longitudinal grooves 33 which are arranged close together and in which possible impurities or snow can be forced when the peg 29 is inserted into the bushing 27. The conical widening at both sides prevents a jamming of the peg inserted into the bushing during the lateral releasing process. While the foregoing description and drawings represent the preferred embodiments of the present invention, it will be obvious to those skilled in the art that various changes and modifications may be made therein without departing from the true spirit and scope of the present invention.

What is claimed is:

1. In a ski boot having a flexible sole which has an area which projects over a front boot cap to cooperate with a clamping device of a front sole holder, said boot having a longitudinal axis and said sole having a particular width, the improvement comprising that the projecting front area of the boot sole has a half-rounded flute at its upper side which extends along the entire width of the sole transversely relative to the longitudinal axis of the boot, and wherein said boot has a heel area and a cut out portion which is open toward the rear and sides is constructed in the heel area of the boot and has a defining wall which is arranged vertically relative to the boot sole and two defining walls extending parallel to the boot sole, which defining walls receive a peg which is arranged vertically relative to the boot sole at a distance from the vertical defining wall and penetrates the cut out portion, and further wherein the boot has a shape and the cut out portion is constructed above the boot sole, said cut out portion projecting toward the rear, said cut out portion being in a hump which is constructed in the heel area and forms part of the shape of the boot.

* * * * *